US011037744B2

(12) United States Patent
Yamagata

(10) Patent No.: US 11,037,744 B2
(45) Date of Patent: Jun. 15, 2021

(54) SWITCH DEVICE

(71) Applicant: ALPS ALPINE CO., LTD., Tokyo (JP)

(72) Inventor: Kazuyoshi Yamagata, Fukushima (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 17/001,996

(22) Filed: Aug. 25, 2020

(65) Prior Publication Data

US 2020/0388452 A1 Dec. 10, 2020

Related U.S. Application Data

(63) Continuation of application No. PCT/JP2018/043972, filed on Nov. 29, 2018.

(30) Foreign Application Priority Data

Mar. 26, 2018 (JP) ..... JP2018-058944

(51) Int. Cl.
*H01H 21/36* (2006.01)
*H01H 19/14* (2006.01)
(Continued)

(52) U.S. Cl.
CPC ..... *H01H 21/36* (2013.01); *H01H 19/14* (2013.01); *H01H 25/04* (2013.01); *H01H 25/06* (2013.01)

(58) Field of Classification Search
CPC ..... H01H 21/36; H01H 25/04; H01H 25/06; H01H 3/02; H01H 3/32; H01H 3/42; H01H 3/46
(Continued)

(56) References Cited

U.S. PATENT DOCUMENTS 8,692,770 B2 * 4/2014 Itoh ..... G06F 3/0338 345/161
8,884,933 B2 * 11/2014 Yokoyama ..... G06F 3/0362 345/184

FOREIGN PATENT DOCUMENTS

| | | |
|---|---|---|
| JP | 2004-288393 | 10/2004 |
| JP | 2016-029645 | 3/2016 |
| JP | 2016-213120 | 12/2016 |

OTHER PUBLICATIONS

International Search Report for PCT/JP2018/043972 dated Feb. 26, 2019.

* cited by examiner

*Primary Examiner* — Edwin A. Leon
*Assistant Examiner* — Iman Malakooti
(74) *Attorney, Agent, or Firm* — IPUSA, PLLC

(57) ABSTRACT

A switch device includes a first switch and a second switch; a support member that houses the first switch and the second switch; a driving member that is inclined in a predetermined inclination direction and presses one of the first switch and the second switch; a holding member disposed on the driving member to be movable in the predetermined inclination direction; and an operation knob. The driving member is disposed to extend over the first and second switches, and includes a pressing portion and a cam portion. The cam portion extends upward from the middle of the pressing portion. A first cam surface having a concave shape is formed on the upper end of the cam portion. The holding member has a recessed portion into which the cam portion is inserted, and a projecting portion projecting downward from the center of the recessed portion and contacting the first cam surface.

8 Claims, 13 Drawing Sheets

(51) Int. Cl.
*H01H 25/04* (2006.01)
*H01H 25/06* (2006.01)

(58) Field of Classification Search
USPC ..... 200/4, 5 R, 6 A, 6 R, 17 R, 18, 329, 179
See application file for complete search history.

SWITCH DEVICE

CROSS-REFERENCE TO RELATED APPLICATIONS

This application is a continuation of International Application No. PCT/JP2018/043972, filed on Nov. 29, 2018 and designating the U.S., which claims priority to Japanese Patent Application No. JP2018-058944 filed on Mar. 26, 2018. The contents of these applications are incorporated herein by reference in their entirety.

BACKGROUND OF THE INVENTION

1. Field of the Invention

The disclosures herein relate to a switch device.

2. Description of the Related Art

In recent years, vehicle power seats whose positions are electrically adjusted are known. For the vehicle power seats, various switch devices for driving a movable part in a desired direction have been proposed. For example, a switch device has been proposed that includes an operation knob, a driving body that is inclined to press a switch, and a holding member that causes the driving body to be inclined in accordance with the operation of the operation knob. In the above switch device, an actuator, included in the driving body and biased by a coil spring, contacts the cam surface formed on the bottom of the holding member, thereby making it possible to automatically return the operation knob to the initial position while also minimizing backlash at the initial position.

However, in the above-described conventional switch device, the coil spring and the actuator having long operating strokes are used. Therefore, it is difficult to reduce the size of the switch device and the number of parts included in the switch device.

RELATED-ART DOCUMENTS

Patent Documents

[Patent Document 1] Japanese Laid-Open Patent Publication No. 2016-029645

SUMMARY OF THE INVENTION

It is a general object of the described embodiments to provide a switch device that can be reduced in size.

According to an aspect of an embodiment, a switch device includes a first switch and a second switch each configured to return to an initial state by elastic force; a support member that houses the first switch and the second switch; a driving member supported by the support member such that the driving member is inclined in a predetermined inclination direction and presses one of the first switch and the second switch; a holding member disposed on the driving member to be movable in the predetermined inclination direction; and an operation knob held by the holding member. The driving member is disposed to extend over the first switch and the second switch, and includes a pressing portion and a cam portion. The pressing portion has a shaft at the center thereof, the cam portion extends upward from the middle of the pressing portion, and a first cam surface having a concave shape is formed on the upper end of the cam portion. The holding member has a recessed portion into which the cam portion of the driving member is inserted, and a projecting portion that projects downward from the center of the recessed portion and that contacts the first cam surface.

BRIEF DESCRIPTION OF THE DRAWINGS

Other objects and further features of the present invention will be apparent from the following detailed description when read in conjunction with the accompanying drawings, in which.

DESCRIPTION OF THE EMBODIMENTS

According to an aspect of an embodiment, it is possible to provide a switch device that can be reduced in size.

In the following, embodiments of the present invention will be described with reference to the accompanying drawings. In the specification and drawings, elements having substantially the same functions or configurations are denoted by the same numerals, and a duplicate description thereof will not be provided.

A switch device 100 according to an embodiment will be described with reference to FIG. 1 through FIG. 13. The switch device 100 according to the present embodiment is a momentary switch in which an operation knob returns to the initial position when a user releases the hand from the operation knob. For example, the switch device 100 may be used as a switch device for driving a movable part of a vehicle power seat in a desired direction.

Figure 1:
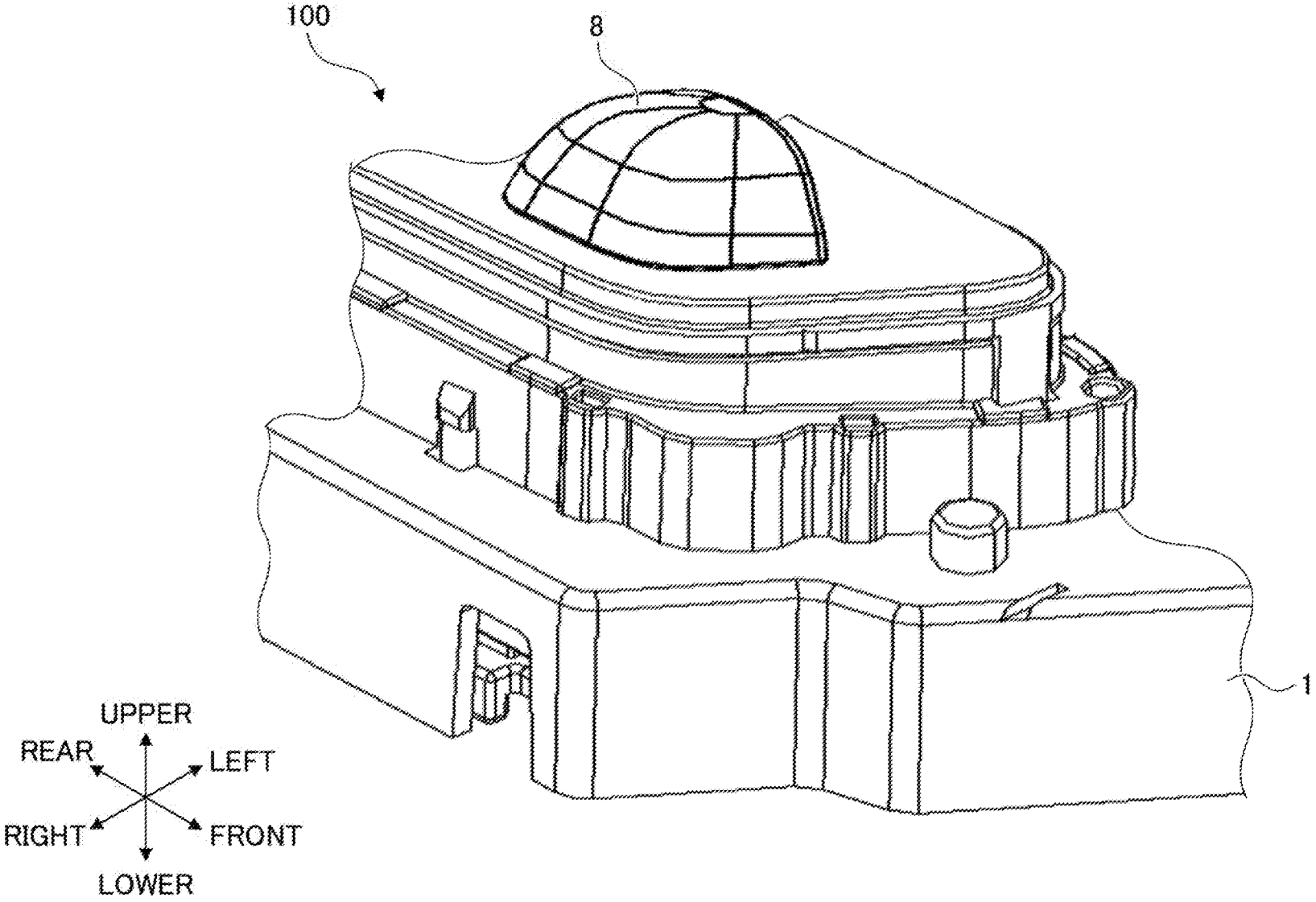
FIG. 1 is a perspective view of an example of the exterior of a switch device.
Figure 2:
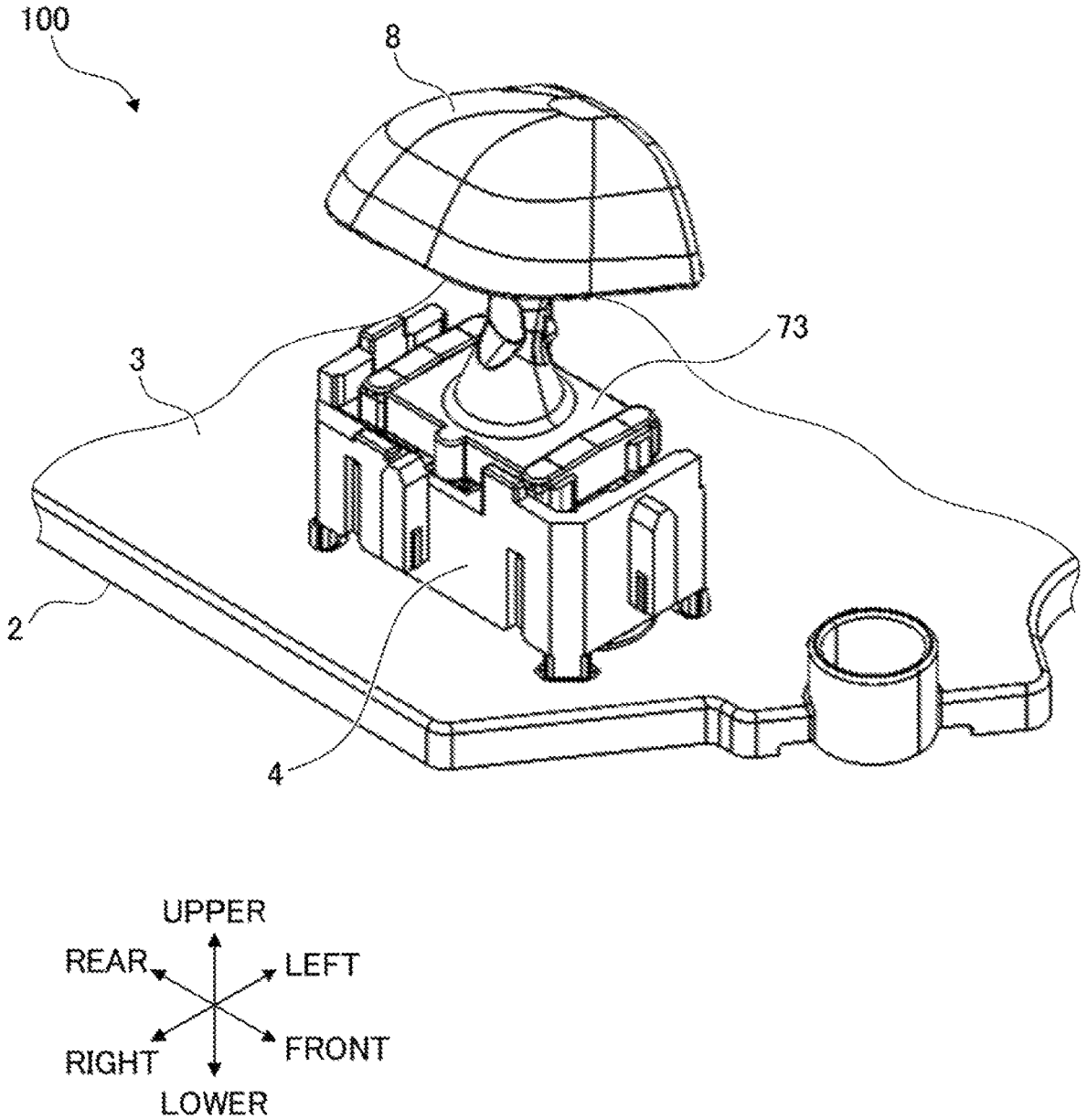
FIG. 2 is a perspective view of an example of the internal configuration of the switch device.
Figure 3:
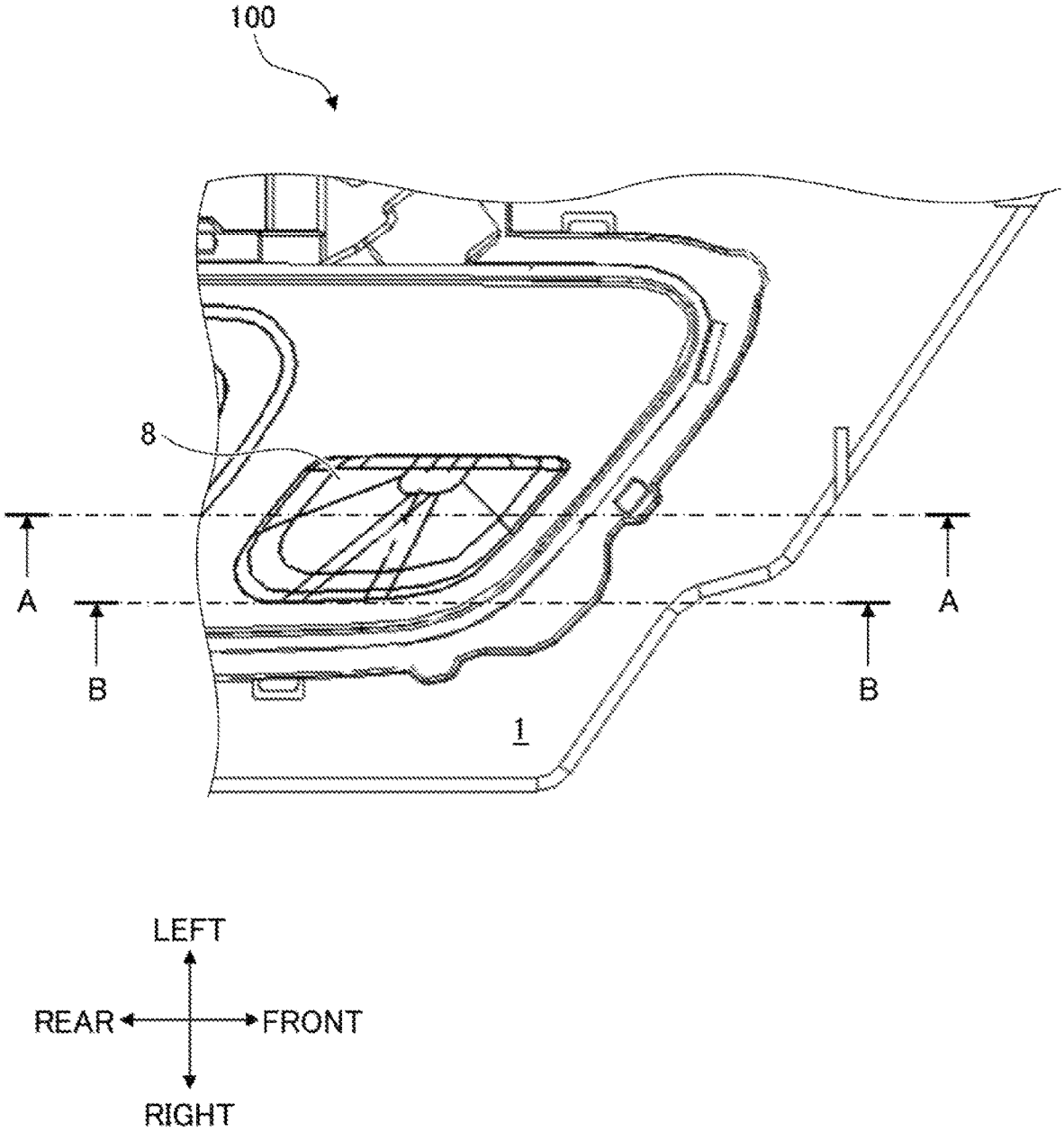
FIG. 3 is a plan view of the switch device of FIG. 1.
Figure 4:
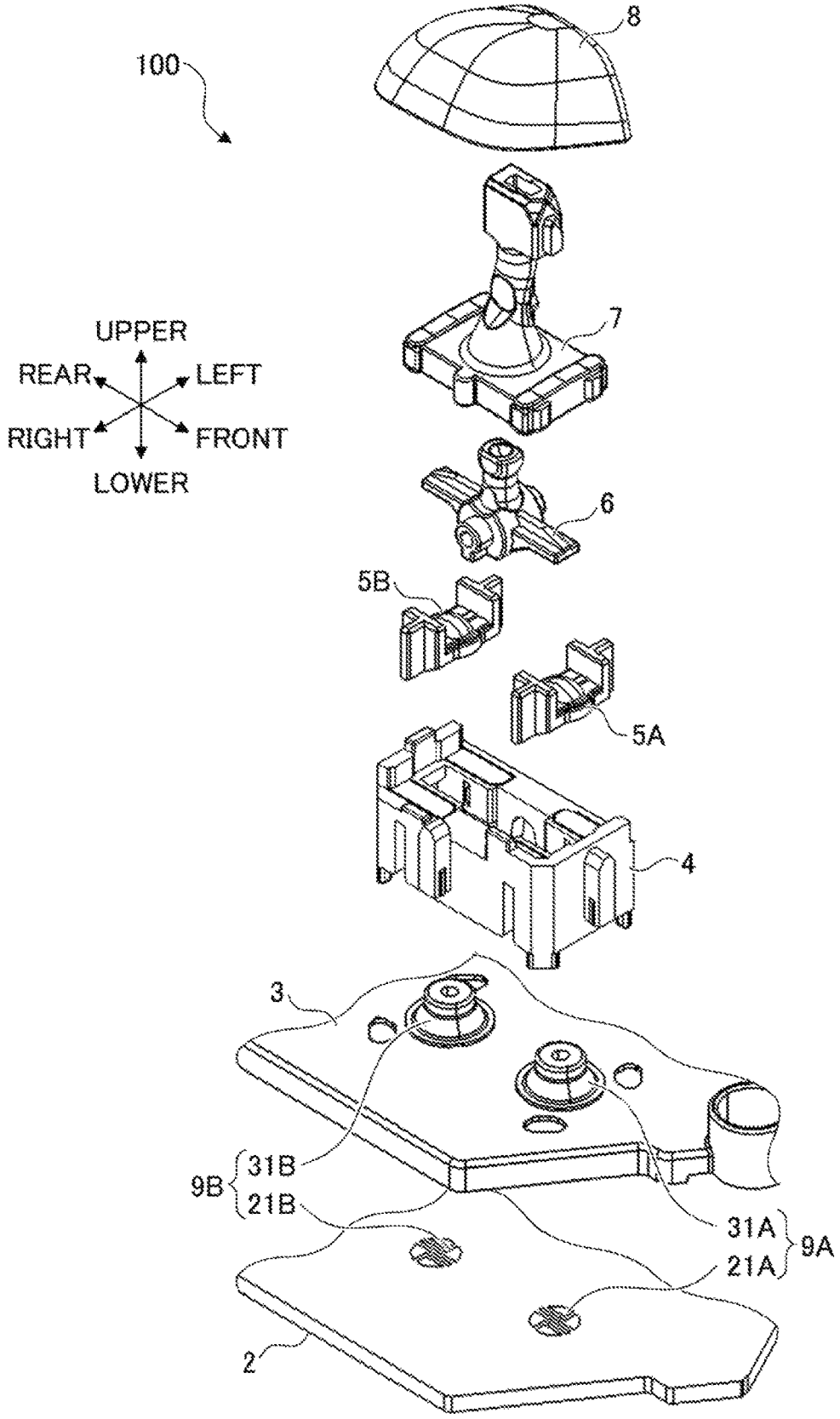
FIG. 4 is an exploded perspective view of the switch device of FIG. 2.
Figure 5:
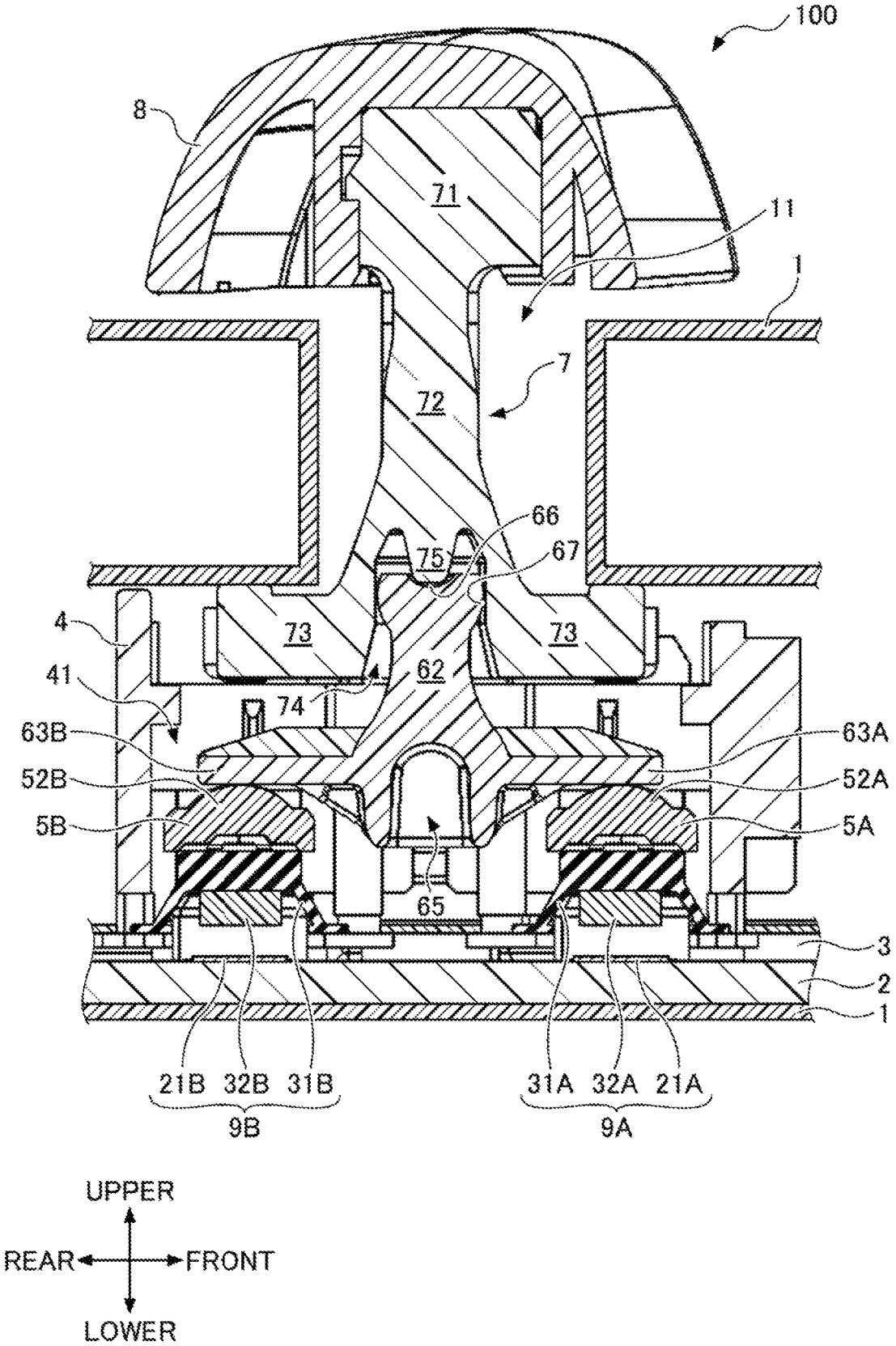
FIG. 5 is a cross-sectional view of the switch device taken through A-A of FIG. 3.
Figure 6:
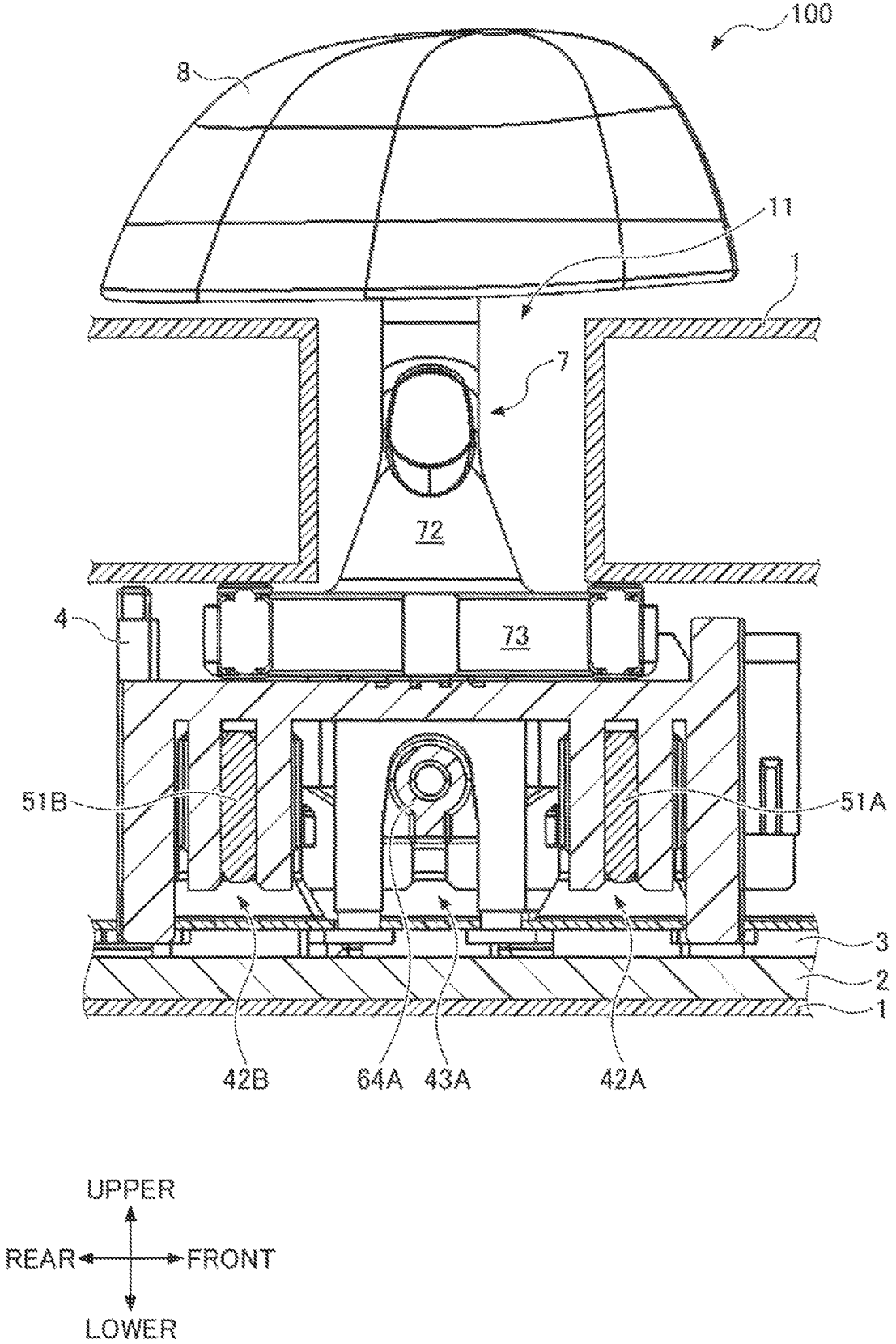
FIG. 6 is a cross-sectional view of the switch device taken through B-B of FIG. 3.

FIG. 1 is a perspective view of an example of the exterior of the switch device 100. FIG. 2 is a perspective view of an example of the internal configuration of the switch device 100. FIG. 2 corresponds to FIG. 1 in which a housing 1 is not depicted. FIG. 3 is a plan view of the switch device 100 of FIG. 1. FIG. 4 is an exploded perspective view of the switch device 100 of FIG. 2. FIG. 5 is a cross-sectional view of the switch device 100 taken through A-A of FIG. 3. FIG. 6 is a cross-sectional view of the switch device 100 taken through B-B of FIG. 3. In the following, the directions (front, rear, left, right, upper, and lower directions) indicated in the figures will be described as the directions of the switch device 100; however, the directions of the switch device 100 are not limited thereto.

The switch device 100 includes the housing 1, a substrate 2, an elastic resin layer 3, a support member 4, sliding members 5A and 5B, a driving member 6, a holding member 7, and an operation knob 8.

The housing 1 houses the substrate 2, the elastic resin layer 3, the support member 4, the sliding members 5A and 5B, the driving member 6, and the holding member 7. The housing 1 may be formed integrally, or may be formed by a combination of a plurality of members as illustrated in the example of FIG. 1. As illustrated in FIG. 5, the housing 1 has an opening 11 through the upper surface, and the holding member 7 passes through the opening 11 to the outside of the housing 1. The opening 11 is formed such that the holding member 7 does not collide with the housing 1 when the operation knob 8 is moved in the front-rear direction.

The substrate 2 is a printed circuit board, and is fixed to the housing 1. The substrate 2 may be a rigid substrate or a flexible substrate. Although not illustrated, a printed circuit is formed on the upper surface of the substrate 2. As illustrated in FIG. 4, fixed contacts 21A and 21B are formed on the upper surface of the substrate 2.

The fixed contact 21A is a contact constituting a switch 9A (first switch), and is located on the front side relative to the fixed contact 21B. The fixed contact 21A includes a plurality of contacts that are not electrically connected to each other.

The fixed contact 21B is a contact constituting a switch 9B (second switch), and is located on the rear side relative to the fixed contact 21A. The fixed contact 21B includes a plurality of contacts that are not electrically connected to each other.

The elastic resin layer 3 is an insulating layer formed on an elastic resin such as rubber, and is disposed on the substrate 2. The elastic resin layer 3 includes domes 31A and 31B and movable contacts 32A and 32B as illustrated in FIG. 5.

The dome 31A is a dome-shaped portion formed of an elastic resin, and is disposed above the fixed contact 21A to cover the fixed contact 21A. The movable contact 32A is a contact disposed on the lower surface of the top portion of the dome 31A, and contacts the fixed contact 21A when the dome 31A is pressed downward. The switch 9A is configured by the fixed contact 21A, the dome 31A, and the movable contact 32A.

Upon the dome 31A being pressed downward, the movable contact 32A contacts the fixed contact 21A, thereby causing the plurality of contacts included in the fixed contact 21A to be electrically connected to each other. As a result, the switch 9A is turned on. Upon the completion of the pressing of the dome 31A, the dome 31A returns to the original shape (initial state) by the elastic force, and the movable contact 32A is separated from the fixed contact 21A. As a result, the switch 9A is turned off.

The dome 31B is a dome-shaped portion formed of an elastic resin, and is disposed above the fixed contact 21B to cover the fixed contact 21B. The movable contact 32B is a contact disposed on the lower surface of the top portion of the dome 31B, and contacts the fixed contact 21B when the dome 31B is pressed downward. The switch 9B is configured by the fixed contact 21B, the dome 31B, and the movable contact 32B. The switch 9B is located on the rear side relative to the switch 9A.

Upon the dome 31B being pressed downward, the movable contact 32B contacts the fixed contact 21B, thereby causing the plurality of contacts included in the fixed contact 21B to be electrically connected to each other. As a result, the switch 9B is turned on. Upon the completion of the pressing of the dome 31B, the dome 31B returns to the original shape (initial state) by the elastic force, and the movable contact 32B is separated from the fixed contact 21B. As a result, the switch 9B is turned off.

Figure 7:
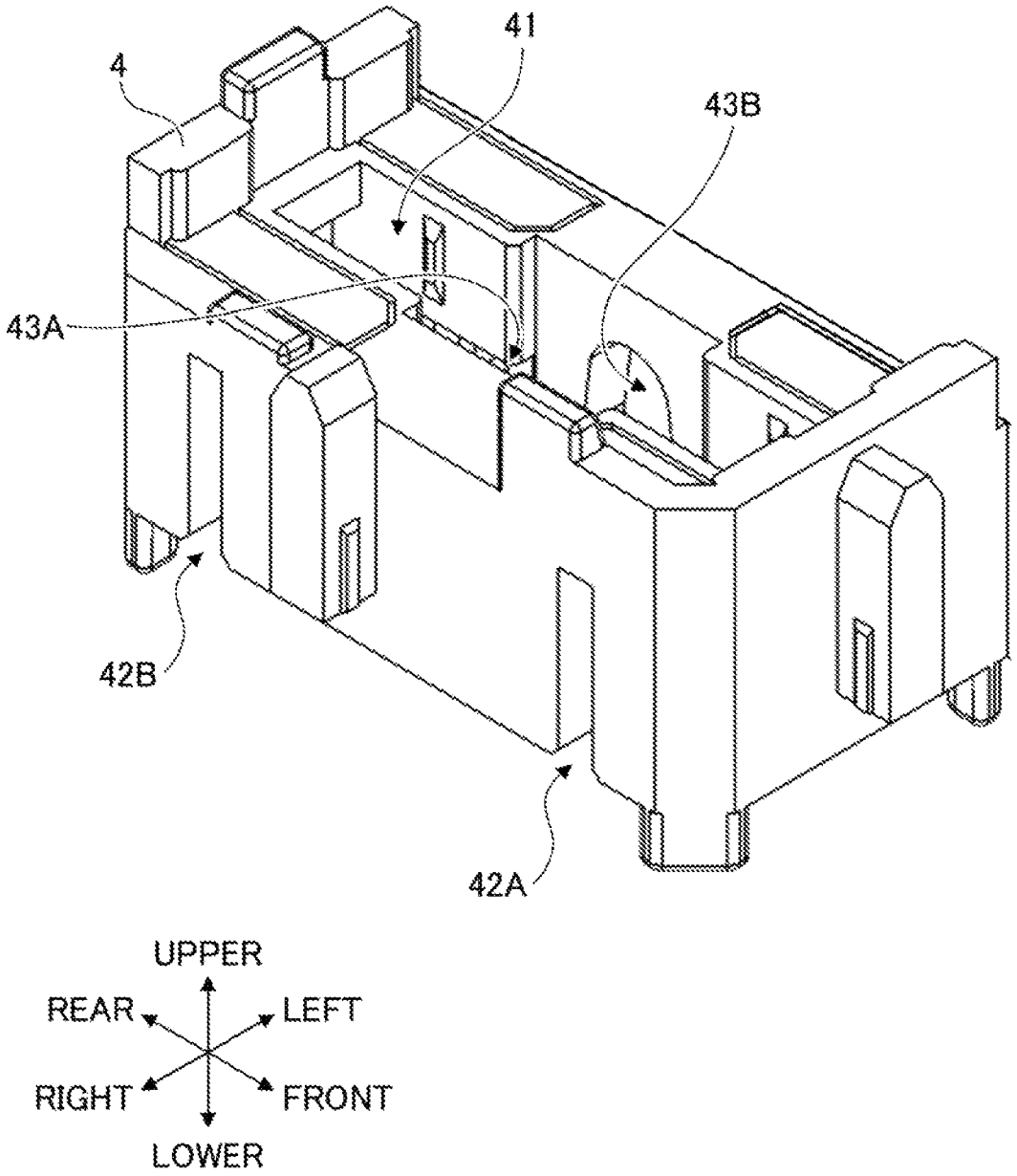
FIG. 7 is a perspective view of a support member.

The support member 4 has an approximately rectangular parallelepiped shape, and is disposed on the elastic resin layer 3. The support member 4 houses the sliding members 5A and 5B, the driving member 6, the switch 9A, and the switch 9B. The lower ends of the support member 4 are fixed to the elastic resin layer 3. The lower ends of the support member 4 may be fixed to the substrate 2 via through holes formed on the elastic resin layer 3. FIG. 7 is a perspective view of the support member 4. As illustrated in FIG. 7, the support member 4 includes a casing 41, a pair of slits 42A, a pair of slits 42B, and bearings 43A and 43B.

The casing 41 is a through-hole in the upper-lower direction. The casing 41 is formed at the center of the support member 4, and extends in the front-rear direction. The sliding members 5A and 5B, the driving member 6, the switch 9A, and the switch 9B are disposed within the casing 41.

The slits 42A guide the sliding member 5A such that the sliding member 5A slides in the upper-lower direction. The slits 42A extend upward from the bottom of the support member 4. The slits 42A are formed at positions opposite to each other on the left side surface and the right side surface of the support member 4.

The slits 42B guide the sliding member 5B such that the sliding member 5B slides in the upper-lower direction. The slits 42B extend upward from the bottom of the support member 4. The slits 42B are formed at positions opposite to each other on the left side surface and the right side surface of the support member 4. As illustrated in FIG. 7, the pair of slits 42B are located on the rear side relative to the pair of slits 42A.

The bearing 43A is a recessed portion that rotatably supports a shaft 64A of the driving member 6, and is provided at the center of the right side surface of the support member 4. The bearing 43A supports the shaft 64A such that the shaft 64A can be moved downward from a reference position. The reference position is a position where the shaft 64A is located when the operation knob 8 is in the initial position, and corresponds to an upper end portion of the bearing 43A as illustrated in FIG. 6. The bearing 43A becomes wider downward such that the shaft 64A can be moved downward from the reference position (the upper end portion of the bearing 43A).

The bearing 43B is a recessed portion that rotatably supports a shaft 64B of the driving member 6, and is provided at the center of the left side surface of the support member 4. The bearing 43B is disposed opposite to the bearing 43A. The bearing 43B supports the shaft 64B such that the shaft 64B can be moved downward from a reference position. The reference position is a position where the shaft 64B is located when the operation knob 8 is in the initial position, and corresponds to an upper end portion of the bearing 43B. The bearing 43B becomes wider downward such that the shaft 64B can be moved downward from the reference position (the upper end portion of the bearing 43B).

Figures 8A, 8B:
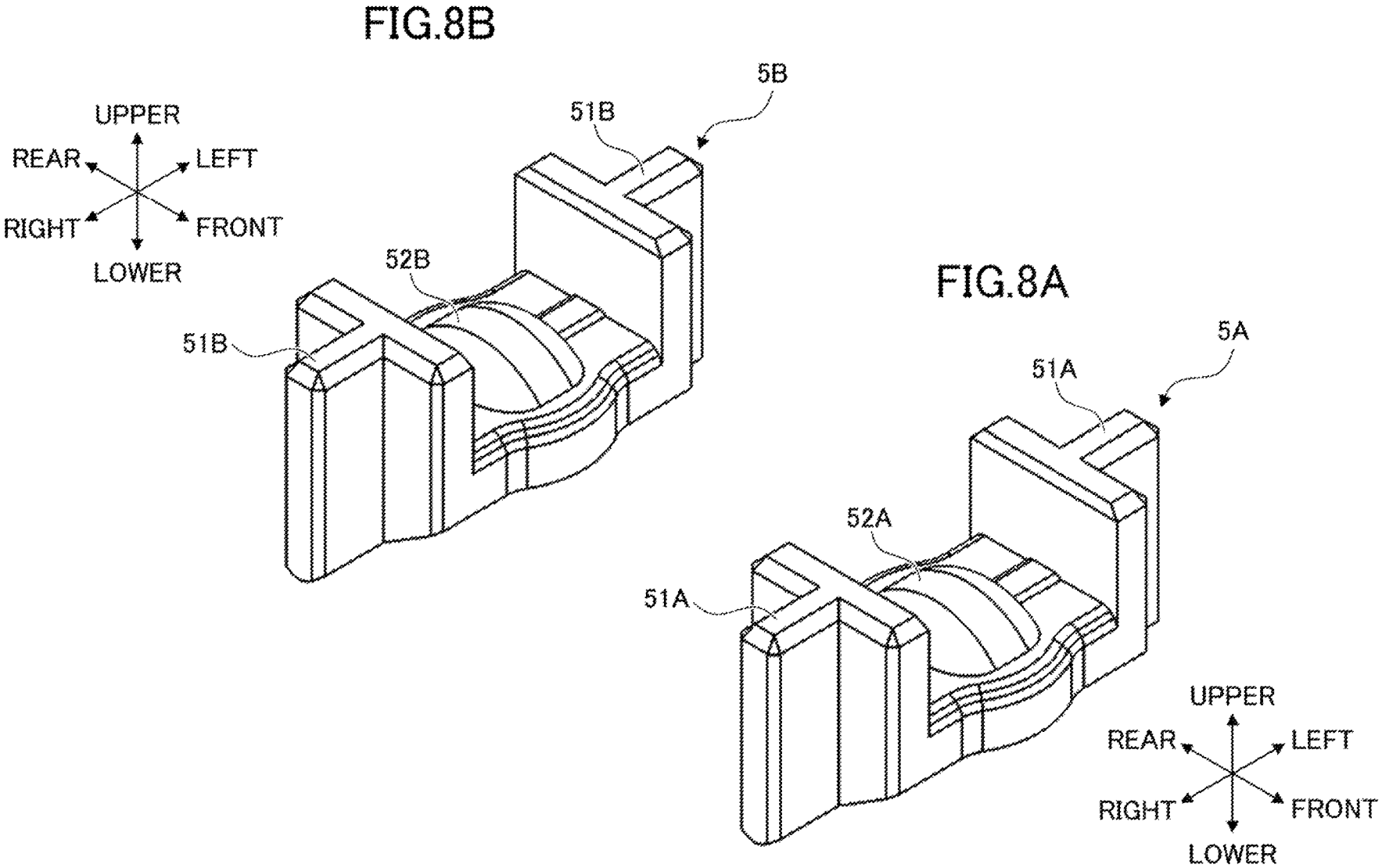
FIGS. 8A and 8B are perspective views of sliding members.

The sliding member 5A is a member that mediates the transmission of force between the driving member 6 and the switch 9A, and is disposed between the driving member 6 and the switch 9A as illustrated in FIG. 5. More specifically, the sliding member 5A is disposed on the dome 31A, and a front portion 63A of a pressing portion 61 of the driving member 6 is disposed on the sliding member 5A. FIGS. 8A and 8B are perspective views of the sliding members 5A and 5B. As illustrated in FIG. 8A, the sliding member 5A includes a pair of guide portions 51A and a pressed portion 52A.

The guide portions 51A are inserted into the slits 42A of the support member 4. The guide portions 51A are formed at positions opposite to each other on the left side surface and the right side surface of the support member 4, and project outward. By inserting the pair of guide portions 51A into the pair of slits 42A, the movement of the sliding member 5A in the front, rear, left, and right directions is restricted, and the sliding member 5A is slidably supported in the upper-lower direction. In the example of FIG. 8A, the guide portions 51A have plate shapes that are thinner than the slits 42A; however, the guide portions 51A may have any shape as long as the guide portions 51A can be inserted into the slits 42A.

The pressed portion 52A is pressed by the pressing portion 61 of the driving member 6, and the center of the pressed portion 52A protrudes upward. The pressed portion 52A is preferably formed in a spherical or cylindrical shape, such that the driving member 6 can make uniform contact with the pressing portion 61 even when the driving member 6 is inclined.

The sliding member 5B is a member that mediates the transmission of force between the driving member 6 and the switch 9B, and is disposed between the driving member 6 and the switch 9B as illustrated in FIG. 5. More specifically, the sliding member 5B is disposed on the dome 31B, and a rear portion 63B of the pressing portion 61 of the driving member 6 is disposed on the sliding member 5B. As illustrated in FIG. 8B, the sliding member 5B includes a pair of guide portions 51B and a pressed portion 52B.

The guide portions 51B are inserted into the slits 42B of the support member 4. The guide portions 51B are formed at positions opposite to each other on the left side surface and the right side surface of the support member 4, and project outward. By inserting the pair of guide portions 51B into the pair of slits 42B, the movement of the sliding member 5B in the front, rear, left, and right directions is restricted, and the sliding member 5B is slidably supported in the upper-lower direction. In the example of FIG. 8B, the guide portions 51B have plate shapes that are thinner than the slits 42B; however, the guide portions 51B may have any shape as long as the guide portions 51B can be inserted into the slits 42B.

The pressed portion 52B is pressed by the pressing portion 61 of the driving member 6, and the center of the pressed portion 52B protrudes upward. The pressed portion 52B is preferably formed in a spherical or cylindrical shape, such that the driving member 6 can make uniform contact with the pressing portion 61 even when the driving member 6 is inclined.

Figure 9:
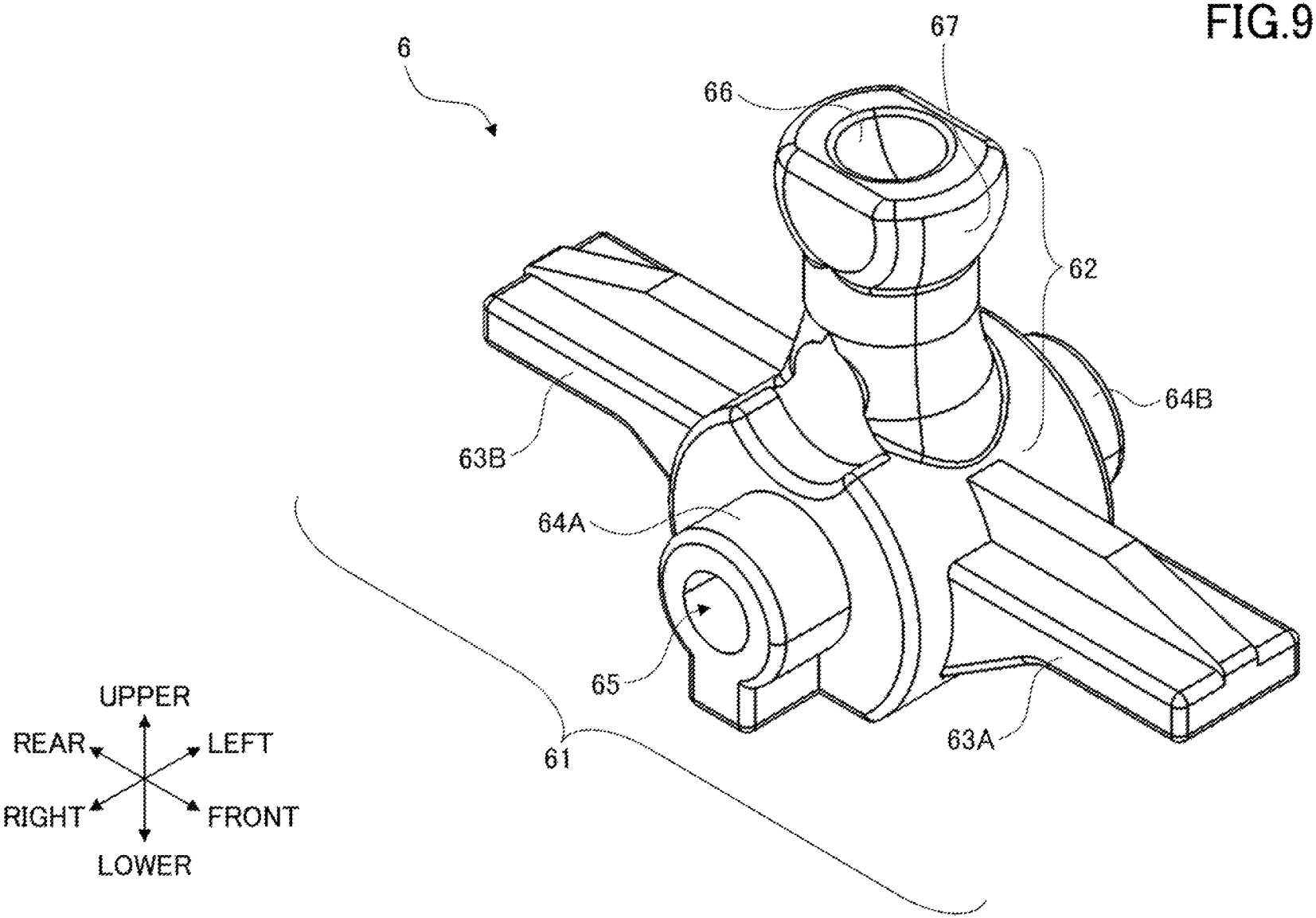
FIG. 9 is a perspective view of a driving member.

The driving member 6 is inclined in the front-rear direction (inclination direction) in accordance with the operation of the operation knob 8, and presses the switch 9A and switch 9B. The driving member 6 is disposed on the sliding members 5A and 5B, and is supported by the support member 4 such that the driving member 6 is inclined in the front-rear direction. FIG. 9 is a perspective view of the driving member 6. As illustrated in FIG. 9, the driving member 6 includes the pressing portion 61 and a cam portion 62.

The pressing portion 61 is a lower portion of the driving member 6, and extends over the switch 9A and the switch 9B in the front-rear direction. When the driving member 6 is inclined, the pressing portion 61 presses one of the switch 9A and the switch 9B. The pressing portion 61 includes the front portion 63A, the rear portion 63B, the shafts 64A and 64B, and a groove 65.

The front portion 63A is a flat plate-shaped portion located on the front side of the pressing portion 61. The front portion 63A is disposed on the pressed portion 52A of the sliding member 5A. The rear portion 63B is a flat plate-shaped portion located on the rear side of the pressing portion 61. The rear portion 63B is disposed on the pressed portion 52B of the sliding member 5B. The shafts 64A and 64B are rotating shafts of the pressing portion 61. The shafts 64A and 64B are disposed opposite to each other on the right side surface and the left side surface at the center of the pressing portion 61. The groove 65 is a recess formed for minimizing sink marks. Grooves may be appropriately formed at the center of the side surface of each of the shafts 64A and 64B as illustrated in FIG. 9, and at the center of the lower surface of the pressing portion 61 as illustrated in FIG. 5.

The reference positions of the shafts 64A and 64B correspond to the positions of the shafts 64A and 64B when the pressing portion 61 is disposed on the sliding members 5A and 5B. The bearings 43A and 43B are formed such that the upper end portions of the bearings 43A and 43B coincide with the reference positions of the shafts 64A and 64B.

The cam portion 62 causes the driving member 6 to be inclined in the front-rear direction in accordance with the movement of the holding member 7 in the front-rear direction. The cam portion 62 extends upward from the center of the pressing portion 61. The cam portion 62 includes a first cam surface 66 and a second cam surface 67.

The first cam surface 66 is a cam surface having a concave shape and formed at the upper end of the cam portion 62. The first cam surface 66 contacts a projecting portion 75 of the holding member 7. The second cam surface 67 is a cam surface having a convex shape and formed at the upper front and rear of the cam portion 62. The second cam surface 67 contacts a recessed portion 74 of the holding member 7. The first cam surface 66 and the second cam surface 67 will be described later in detail.

Figure 10:
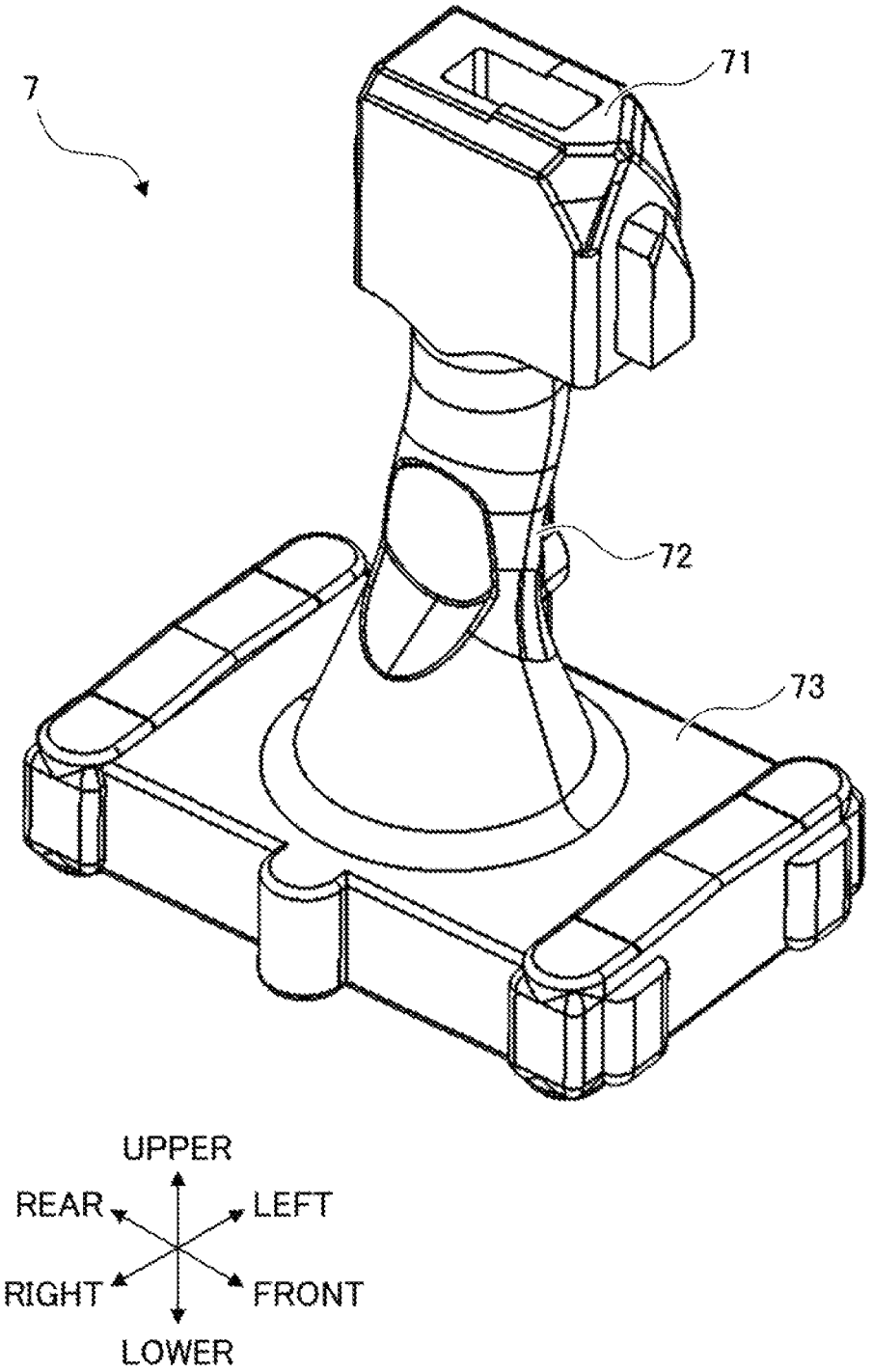
FIG. 10 is a perspective view of a holding member.

The holding member 7 is a member that holds the operation knob 8. The holding member 7 is disposed on the driving member 6 to project from the opening of the housing 1 upwardly relative to the upper surface of the housing 1. The holding member 7 holds the operation knob 8 at the upper end, and the holding member 7 moves in the front-rear direction together with the operation knob 8. When the holding member 7 is moved in the front-rear direction, the driving member 6 is inclined in the front-rear direction. FIG. 10 is a perspective view of the holding member 7. As illustrated in FIG. 10, the holding member 7 includes a holding portion 71, a coupling portion 72, and a bottom portion 73.

The holding portion 71 is a portion that holds the operation knob 8, and is provided at the upper end of the holding member 7. The holding portion 71 is located on the upper side relative to the housing 1. The holding portion 71 may hold the operation knob by engaging with the operation knob 8, or may be fixed to the operation knob 8 with an adhesive or a screw. Alternatively, the holding member 7 and the operation knob 8 may be integrally formed.

The coupling portion 72 is a portion that connects the holding portion 71 to the bottom portion 73, and is inserted into the opening 11 of the housing 1 as illustrated in FIG. 5. The coupling portion 72 becomes wider downward such that the recessed portion 74, which will be described later, is formed.

The bottom portion 73 is a flat, plate-shaped portion that restricts the movement of the holding member 7 in the upper-lower direction, and is provided at the lower end of the holding member 7. The bottom portion 73 is disposed between the support member 4 and the housing 1. More specifically, the bottom portion 73 is disposed such that the lower surface of the bottom portion 73 contacts the upper surface of the support member 4 and the upper surface of the bottom portion 73 contacts the lower surface of the housing 1. As described above, the movement of the holding member 7 in the upper-lower direction is restricted by the bottom portion 73 disposed between the support member 4 and the housing 1. When the user moves the operation knob 8 in the front-rear direction, the bottom portion 73 slides between the support member 4 and the housing 1 in the front-rear direction. The recessed portion 74 and the projecting portion 75 are formed at the center of the lower surface of the bottom portion 73.

The recessed portion 74 is a portion into which the cam portion 62 of the driving member 6 is inserted, and extends from the lower surface of the bottom portion 73 to the lower portion of the coupling portion 72. The recessed portion 74 contacts the second cam surface 67. The recessed portion 74 becomes wider downward so as not to collide with the cam portion 62 when the driving member 6 is inclined.

The projecting portion 75 is a portion that projects downward from the center of the recessed portion 74, and contacts the first cam surface 66. The holding member 7 is preferably disposed such that the projecting portion 75 is pressed upward by the first cam surface 66 due to the elastic force of the domes 31A and 31B when the operation knob 8 is in the initial position. Accordingly, it becomes possible to minimize backlash of the holding member 7 when the control knob 8 is in its initial position. The recessed portion 74 and the projecting portion 75 will be described later in detail.

The operation knob is operated by the user in the front-rear direction. The operation knob 8 is held by the holding member 7 above the upper surface of the housing 1. When the operation knob 8 is not in operation, the operation knob 8 is in the initial position.

Figure 11:
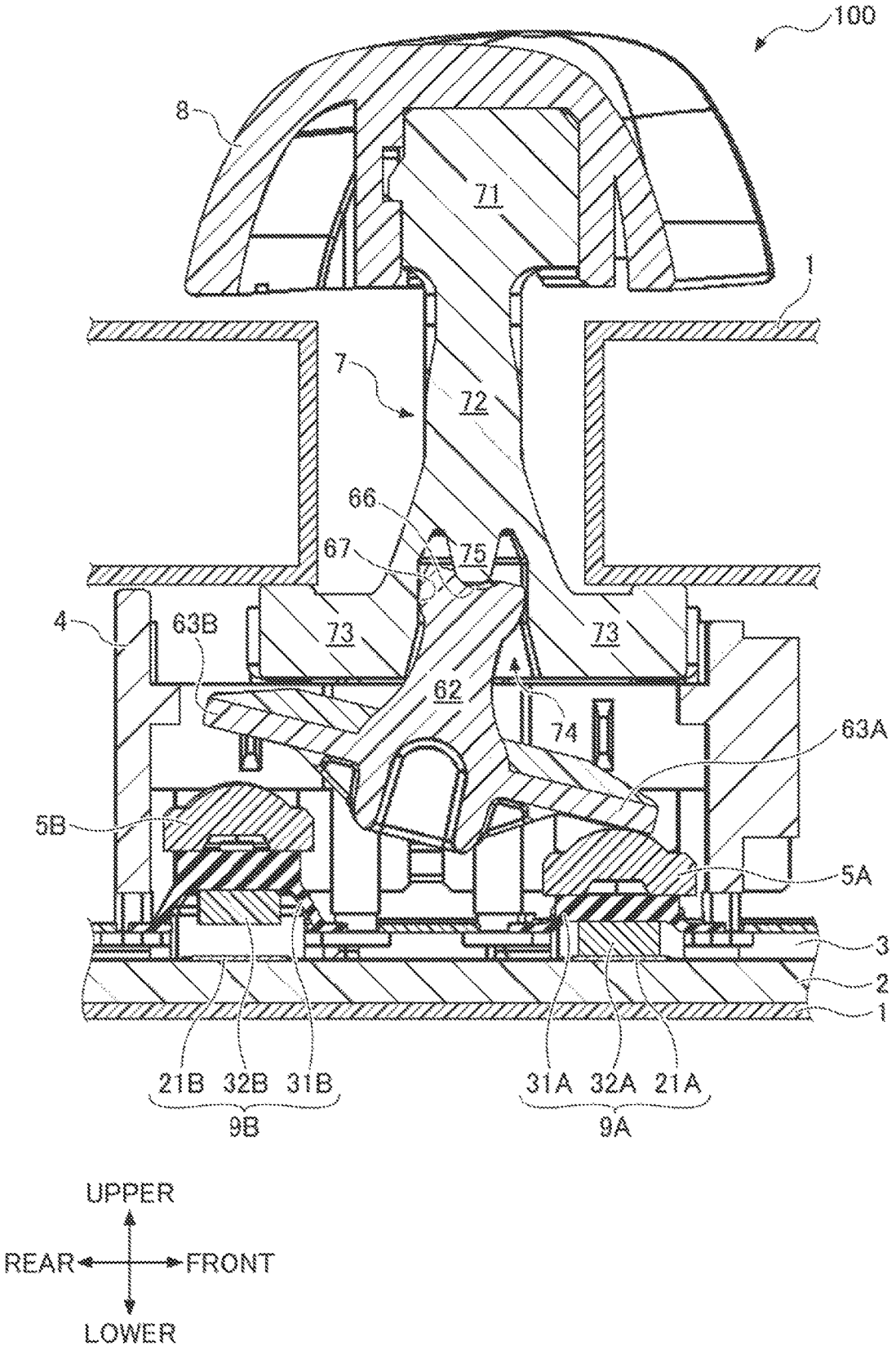
FIG. 11 is a cross-sectional view of the switch device taken through A-A of FIG. 3 in which an operation knob is moved forward.

Next, the operation of the switch device 100 will be described. In the following, an example operation in which the operation knob 8 is moved forward will be described. The same applies to a case where the operation knob 8 is moved backward. FIG. 11 is a cross-sectional view of the switch device 100 taken through A-A of FIG. 3 when the operation knob 8 is moved forward.

When the user moves the operation knob 8 forward, the holding member 7 moves forward together with the operation knob 8, thereby causing the recessed portion 74 to press the second cam surface 67 forward while causing the projecting portion 75 to press the first cam surface 66 downward. When the second cam surface 67 is pressed forward and the first cam surface 66 is pressed downward, the driving member 6 moves downward while rotating forward about the shafts 64A and 64B. That is, the driving member 6 is inclined forward.

When the driving member 6 is inclined forward, the front portion 63A of the driving member 6 presses the sliding member 5A downward, the sliding member 5A moves downward, and the dome 31A is pressed downward. When the dome 31A is pressed downward, the shape of the dome 31A is elastically deformed and the top portion of the dome 31A moves downward.

When the user moves the operation knob 8 forward by a predetermined distance, the movable contact 32A provided on the lower surface of the top portion of the dome 31A contacts the fixed contact 21A as illustrated in FIG. 11. As a result, the switch 9A is turned on.

Subsequently, when the user releases the hand from the operation knob 8, the dome 31A returns to the original shape by the elastic force, and the movable contact 32A is separated from the fixed contact 21A. As a result, the switch 9A is turned off. Further, the sliding member 5A is pressed upward by the dome 31A, moves upward, and presses the front portion 63A of the driving member 6 upward.

When the front portion 63A is pressed upward, the driving member 6 moves upward while rotating backward about the shafts 64A and 64B. That is, the driving member 6 is inclined backward. When the driving member 6 is inclined backward, the second cam surface 67 presses the surface of the recessed portion 74 backward, and the first cam surface 66 presses the projecting portion 75 upward. When the surface of the recessed portion 74 is pressed backward, the holding member 7 moves backward together with the operation knob 8. When the operation knob 8 is moved to the initial position, the movement of the operation knob 8 stops. Accordingly, when the operation knob 8 is not operated, the operation knob 8 automatically returns to the initial position by the elastic force of the dome 31A.

Figure 12:
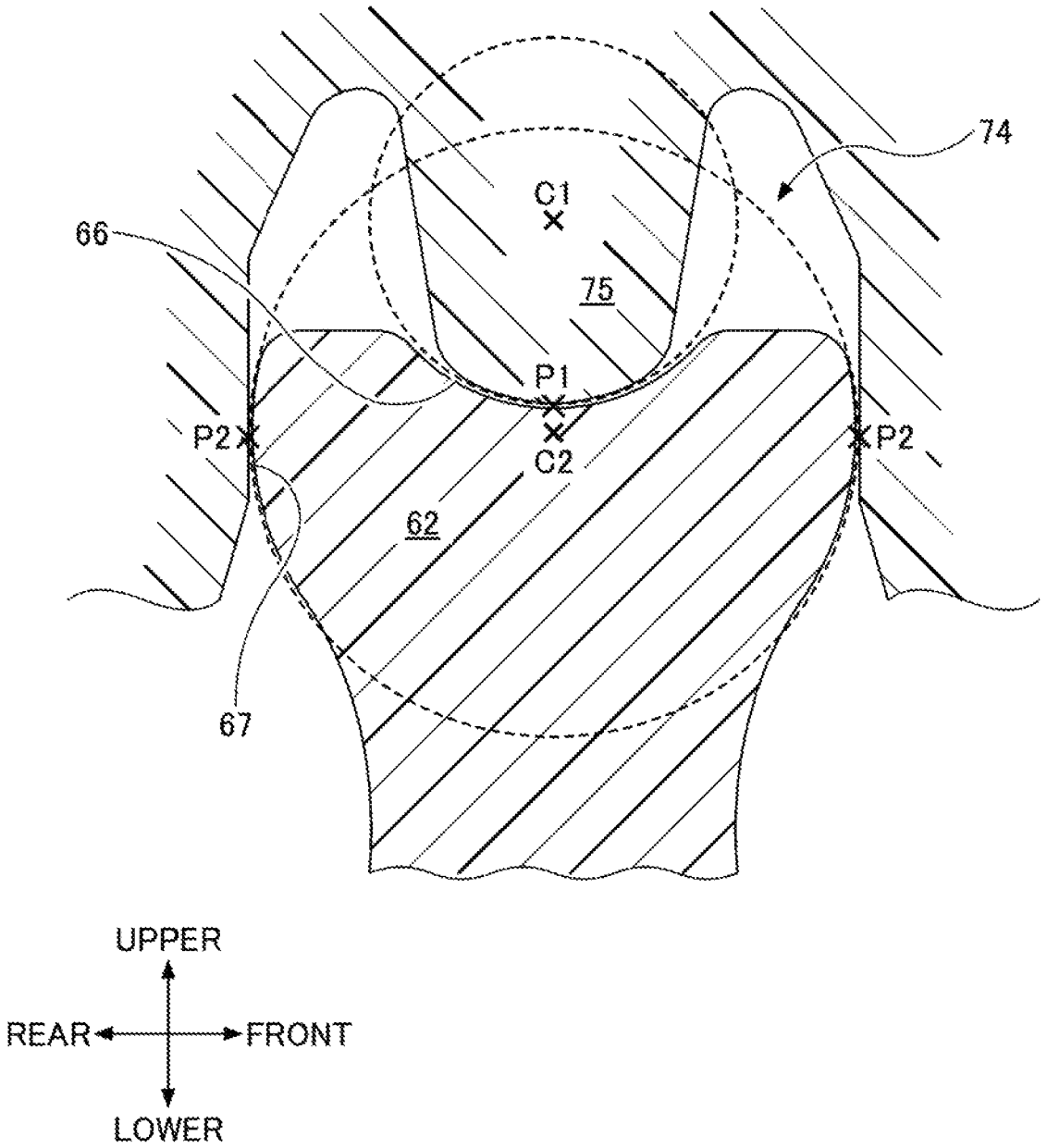
FIG. 12 is an enlarged cross-sectional view of the vicinity of a cam portion when the operation knob is not operated.
Figure 13:
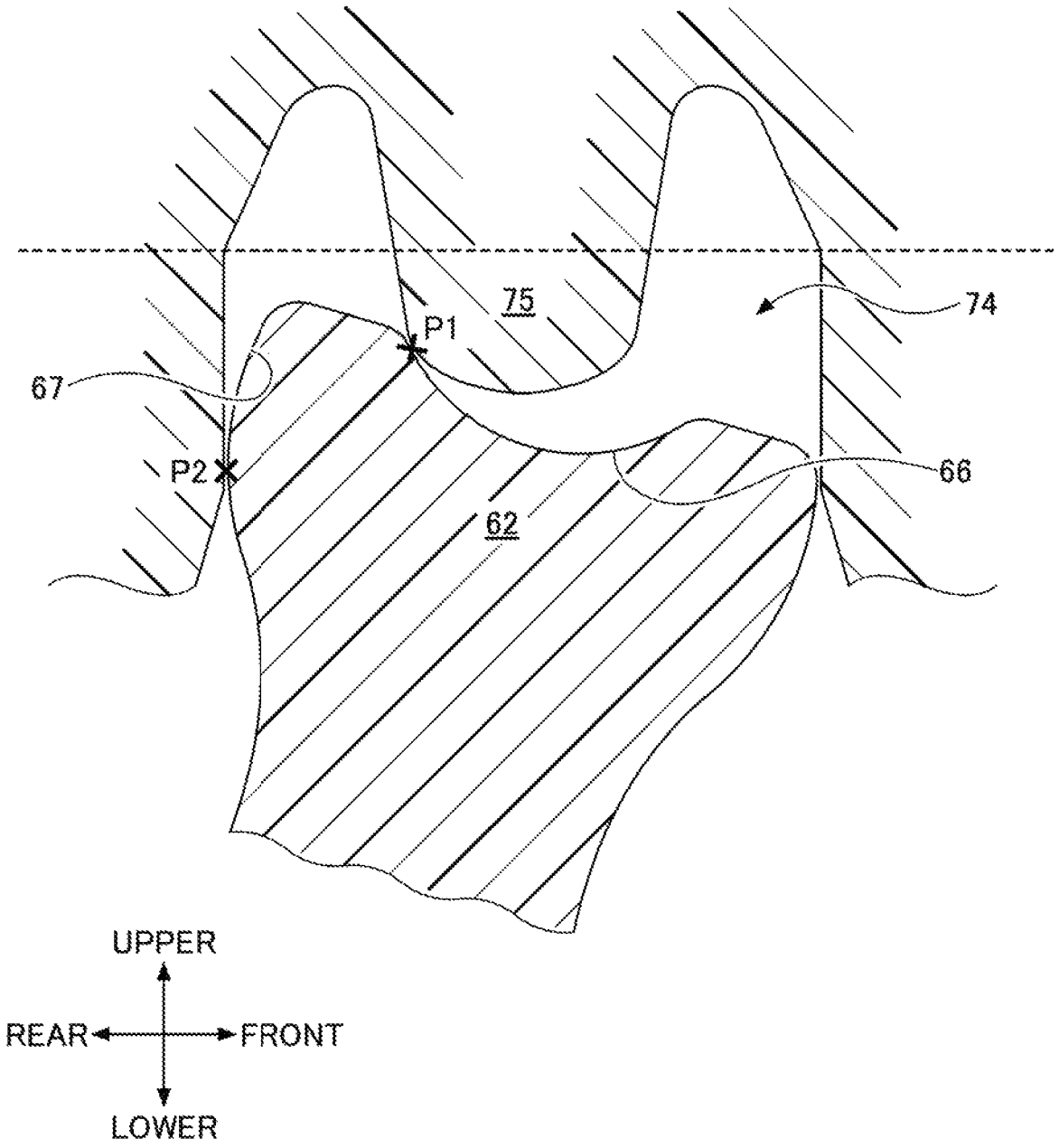
FIG. 13 is an enlarged cross-sectional view of the vicinity of the cam portion when the operation knob is operated.

In the following, the first cam surface 66, the second cam surface 67, the recessed portion 74, and the projecting portion 75 will be described in detail. FIG. 12 is an enlarged cross-sectional view of the vicinity of the cam portion 62 when the operation knob 8 is not operated. FIG. 13 is an enlarged cross-sectional view of the vicinity of the cam portion 62 when the operation knob 8 is operated.

In the present embodiment, as illustrated in FIG. 12 and FIG. 13, it is preferable for the first cam surface 66 and the projecting portion 75 to contact each other both when the operation knob 8 is operated and when the operation knob 8 is not operated. In addition, it is preferable for the second cam surface 67 and the surface of the recessed portion 74 to contact each other both when the operation knob 8 is operated and when the operation knob 8 is not operated. That is, the cam portion 62 is preferably configured to contact the recessed portion 74 and the projecting portion 75 at the same time, both when the operation knob 8 is operated and when the operation knob 8 is not operated. Further, the first cam surface 66, the second cam surface 67, the recessed portion 74, and the projecting portion 75 are formed such that the distance from a contact point P1 between the first cam surface 66 and the projecting portion 75 to a contact point P2 between the second cam surface 67 and the recessed portion 74 decreases as the operation knob 8 moves away from the initial position (as the driving member 6 is inclined).

Specifically, as illustrated in FIG. 12, each of the first cam surface 66 and the second cam surface 67 is preferably formed in a spherical shape in which the center of curvature C1 of the first cam surface 66 is located above the center of curvature C2 of the second cam surface 67, and portions of the recessed portion 74 that contact the second cam surface 67 are preferably formed in a cylindrical shape whose axis is parallel to the upper-lower direction.

With the above-described configuration, as the operation knob 8 moves away from the initial position, a moment applied to contact point P1 increases, with the contact point P2 acting as a fulcrum. As a result, when the operation knob

8 is not operated, the operation knob 8 is stabilized at the initial position where the moment applied to the contact point P1 becomes minimum. Accordingly, the operation knob 8 can be accurately returned to the initial position.

As described above, in the switch device 100 according to the present embodiment, the operation knob 8 returns to the initial position by the elastic force of each of the dome 31A and the dome 31B having short operating strokes. Accordingly, in the switch device 100, the number of parts and the size of the switch device 100 can be reduced, as compared to the conventional switch device in which the operation knob is caused to return to the original position by the coil spring and the actuator having long operating strokes.

In the above, an example in which the inclination direction of the driving member 6 is the front-rear direction has been described; however, the inclination direction is not limited to the front-rear direction. The driving member 6 may be inclined in three or more directions. Further, the switch 9A may be any switch that returns to the initial state by the elastic force. The switch 9A may be a switch including a metal dome (metal leaf spring) instead of the dome 31A and the movable contact 32A, or a tactile switch in which the movable contact 32A is disposed in a case. The same applies to the switch 9B.

Further, the present invention is not limited to the configurations described herein, and other elements may be combined with the above-described configurations. Variations and modifications may be made to the described subject matter without departing from the scope of the invention as set forth in the accompanying claims.

What is claimed is:

1. A switch device comprising:

a first switch and a second switch each configured to return to an initial state by elastic force;

a support member that houses the first switch and the second switch;

a driving member supported by the support member such that the driving member is inclined in a predetermined inclination direction and presses one of the first switch and the second switch;

a holding member disposed on the driving member to be movable in the predetermined inclination direction; and an operation knob held by the holding member; wherein the driving member is disposed to extend over the first switch and the second switch, and includes a pressing portion and a cam portion, the pressing portion having a shaft at a center thereof, the cam portion extending upward from middle of the pressing portion, and a first cam surface having a concave shape being formed on an upper end of the cam portion, and the holding member has a recessed portion into which the cam portion of the driving member is inserted, and a projecting portion that projects downward from a center of the recessed portion and that contacts the first cam surface.

2. The switch device according to claim 1, wherein the support member includes a bearing that supports the shaft such that the shaft is movable downward from a reference position.

3. The switch device according to claim 1, wherein the cam portion contacts the projecting portion and the recessed portion at a same time.

4. The switch device according to claim 3, wherein a distance from a contact point between the cam portion and the projecting portion to a contact point between the cam portion and the recessed portion decreases as the driving member is inclined.

5. The switch device according to claim 1, wherein the cam portion has a second cam surface that has a convex shape and that contacts the recessed portion.

6. The switch device according to claim 5, wherein the first cam surface and the second cam surface are each formed in a spherical shape.

7. The switch device according to claim 5, wherein a center of curvature of the first cam surface is located above a center of curvature of the second cam surface.

8. The switch device according to claim 1, wherein the recessed portion becomes wider downward.

* * * * *